US009528222B2

(12) United States Patent
Ahlgren

(10) Patent No.: US 9,528,222 B2
(45) Date of Patent: Dec. 27, 2016

(54) FEED SCREW ARRANGEMENT

(75) Inventor: Örjan Ahlgren, Sundsvall (SE)

(73) Assignee: Valmet AB (SE)

( * ) Notice: Subject to any disclaimer, the term of this patent is extended or adjusted under 35 U.S.C. 154(b) by 380 days.

(21) Appl. No.: 14/009,220

(22) PCT Filed: Jun. 28, 2012

(86) PCT No.: PCT/SE2012/000099

§ 371 (c)(1),
(2), (4) Date: Oct. 1, 2013

(87) PCT Pub. No.: WO2013/006107

PCT Pub. Date: Jan. 10, 2013

(65) Prior Publication Data

US 2014/0246530 A1 Sep. 4, 2014

(30) Foreign Application Priority Data

Jul. 1, 2011 (SE) ..... 1150621

(51) Int. Cl.
*B02C 7/11* (2006.01)
*D21B 1/22* (2006.01)
*D21D 1/30* (2006.01)

(52) U.S. Cl.
CPC . *D21B 1/22* (2013.01); *B02C 7/11* (2013.01); *D21D 1/30* (2013.01)

(58) Field of Classification Search
CPC ..... D21B 1/22; B02C 7/11; D21D 1/30
USPC ..... 241/246, 247, 260.1; 198/662
See application file for complete search history.

(56) References Cited

U.S. PATENT DOCUMENTS

| | | | | |
|---|---|---|---|---|
| 2,314,706 | A * | 3/1943 | Johnston | B02C 7/182 222/311 |
| 4,220,290 | A | 9/1980 | Johansson | |
| 5,823,453 | A | 10/1998 | Garasimowicz | |
| 6,206,309 | B1 | 3/2001 | Danielsson et al. | |
| 6,494,994 | B1 | 12/2002 | Aikawa | |
| 2001/0011505 | A1 | 8/2001 | Dionne | |

FOREIGN PATENT DOCUMENTS

| | | | |
|---|---|---|---|
| DE | 3823700 | A1 | 9/1989 |
| EP | 0126632 | A2 | 11/1984 |
| SE | 516965 | C2 | 3/2002 |
| SE | 532411 | C2 | 1/2010 |

OTHER PUBLICATIONS

International Search Report for Application No. PCT/SE2012/000099 dated Sep. 17, 2012.

* cited by examiner

*Primary Examiner* — Mark Rosenbaum
(74) *Attorney, Agent, or Firm* — Lerner, David, Littenberg, Krumholz & Mentlik, LLP

(57) ABSTRACT

A feed screw for feeding lignocellulosic material to a rotary disc refiner is disclosed. The feed screw includes at least one peripheral thread for feeding the lignocellulosic material axially towards the disc refiner and the feed screw feeds the lignocellulosic material from its upstream end towards its downstream end through the center of the opposed grinding surfaces of the disc refiner, the downstream end of the peripheral thread including an angled end part disposed at an angle with respect to the peripheral thread such that the lignocellulosic material is redirected in a radial direction as it leaves the end of the peripheral thread.

11 Claims, 3 Drawing Sheets

FEED SCREW ARRANGEMENT

CROSS REFERENCE TO RELATED APPLICATIONS

The present application is a national phase entry under 35 U.S.C. §371 of International Application No. PCT/SE2012/000099 filed Jun. 28, 2012, published in English, which claims priority from SE 1150621-9, filed Jul. 1, 2011, all of which are incorporated herein by reference.

FIELD OF THE INVENTION

The present invention relates to a feed screw for feeding lignocellulose material to a rotary grinder. Specifically, the present invention relates to a feed screw arrangement for feeding lignocellulose material to a grinding zone of a rotary grinder.

BACKGROUND OF THE INVENTION

A rotary grinder may be used for grinding lignocellulose material, such as wood chips, into pulp. Such a grinder comprises two opposed grinding discs, which both include a peripheral ring-formed grinding surface between which the chips are to be ground. Normally, one of these discs is stationary, i.e., the stator disc, and the other is rotary, i.e., the rotor disc. It is, however, also possible to use two counter-rotating grinding discs. In a conventional grinder, where one disc is stationary, an inlet is arranged through the axial center of the stator disc.

Conventionally the chips are conveyed towards the peripheral grinding zone, i.e., the gap between the opposed surfaces of the discs, by means of a feed screw. The feed screw of the feed screw arrangement is normally arranged in the axial direction of the grinder, such that the chips are conveyed in the axial direction through the center of the stator disc and towards the center of the rotor disc. Hence, because the chips are ground in the peripheral grinding zone between the grinding discs, the chips will have to be directed in the radial direction towards the peripheral grinding zone. This redirecting of the chips is normally accomplished by means of plates that are arranged crosswise on the central part of the rotor. The plates may be arranged such that they form a star or a cross which is centered on the rotor disc. The idea is that when the chips hit one of the plates they will be struck in the radial direction towards the peripheral grinding zone.

In reality, it has been proven difficult to control the direction of the chips, which are just as often thrown back into the feed screw as they are thrown in the radial direction towards the grinding zone. Normally, the path of a chip is completely unpredictable and often it bounces back and forth several times before it reaches the grinding zone.

Hence, there is a need for a new arrangement for feeding the chips towards the peripheral grinding zone. Specifically, the arrangement should provide a more predictable feeding of the chips, without the disadvantages of the prior art.

One object of the present invention is to provide an alternative feeding arrangement for feeding lignocellulose material such as wood chips to a grinder. Another object of the present invention is to improve the feeding of lignocellulose material in such a way that it is fed to the peripheral grinding zone of the grinder in a more predictable manner.

SUMMARY OF THE INVENTION

In accordance with the present invention, these and other objects have now been realized by the invention of a feed screw for feeding lignocellulosic material to a rotary disc refiner comprising a pair of opposed grinding surfaces, the feed screw comprising at least one peripheral thread for feeding the lignocellulosic material axially along the feed screw towards the rotary disc refiner, the at least one peripheral thread including an upstream end and a downstream end corresponding to the pair of opposed grinding surfaces whereby the feed screw feeds the lignocellulosic material from the upstream end towards the downstream end through the center of one of said pair of opposed grinding surfaces, the downstream end of the at least one peripheral thread including an angled end member disposed at an angle with respect to the at least one peripheral thread whereby the lignocellulosic material is redirected in a radial direction as it leaves the at least one peripheral thread. In a preferred embodiment, the at least one peripheral thread includes a predetermined pitch angle upstream of the angled end member, and the angled end member includes an increased pitch angle compared to said predetermined pitch angle.

In accordance with one embodiment of the feed screw of the present invention, the angled end member comprises a straight plate fixed to the at least one peripheral thread at an abrupt angle with respect thereto.

In accordance with another embodiment of the feed screw of the present invention, the at least one peripheral thread includes a predetermined pitch angle upstream of the angled end member, and the angled end member includes a smoothly curved surface providing a smoothly increasing pitch angle compared to said predetermined pitch angle.

In accordance with another embodiment of the feed screw of the present invention, the angled end member comprises a continuation of the at least one peripheral thread.

In accordance with another embodiment of the feed screw of the present invention, the angled end member is disposed on a feeding side of the at least one peripheral thread.

In accordance with another embodiment of the feed screw of the present invention, the angled end member includes at least one lateral rim preventing the lignocellulosic material from slipping sideways with respect to the angled end member.

In accordance with another embodiment of the feed screw of the present invention, the feed screw comprises a pair of peripheral threads, each of the pair of peripheral threads include an angled member.

In accordance with another embodiment of the feed screw of the present invention, the feed screw includes an outer cylindrical pipe, the feed screw being disposed within the outer cylindrical pipe.

In accordance with the present invention, a grinder has also been provided comprising a pair of opposed grinding discs and including a feed screw for feeding lignocellulosic material to the grinder, the feed screw including an outer cylindrical pipe whereby the feed screw is disposed within the outer cylindrical pipe, the feed screw including the outer cylindrical pipe disposed extending through the center of the pair of opposed grinding surfaces and into a feed zone between the pair of opposed grinding surfaces, the feed screw including at least one peripheral thread for feeding the lignocellulosic material axially along said feed screw towards the feeding zone between the pair of opposed grinding surfaces, the at least one peripheral thread including an upstream end and a downstream end corresponding to the feeding zone between the pair of opposed grinding surfaces, the downstream end of the at least one peripheral thread including an angled end member disposed at an angle with respect to the at least one peripheral thread whereby the lignocellulosic material is redirected in a radial direction into the feeding zone. In a preferred embodiment, one of the pair of opposed grinding surfaces comprises a stator disc and the other the pair of opposed grinding surfaces comprises a rotor disc, the feed screw and the cylindrical pipe being disposed through the center of the stator disc.

The present invention relates to a feed screw for feeding lignocellulose material to a rotary disc grinder comprising two opposed grinding discs, the feed screw comprising at least one peripheral thread for feeding the lignocellulose material in an axial feeding direction, the peripheral thread having an upstream end from which lignocellulose material is to be fed towards a downstream end, which is to be arranged through the center of one of the grinding discs such that it reaches into a feeding zone between the two opposed grinding discs, wherein the downstream end of the peripheral thread comprises an angled end part, which is arranged at an angle with respect to the peripheral thread so as to re-direct the lignocellulose material in the radial direction as it leaves the peripheral thread.

The feed screw can be a separate machine or mounted on the rotary grinder. Specifically, the present invention also relates to a feed screw arrangement including such a feed screw and to a grinder including such a feed screw arrangement.

With the feed screw according to the present invention an improved feeding of the lignocellulose material is achieved in that the lignocellulose material is fed to the peripheral grinding zone of the grinder in a more predictable manner and with a reduced risk of being rejected from the grinding zone.

BRIEF DESCRIPTION OF THE DRAWINGS

The present invention, and further objects and advantages of it, is best understood from the following detailed description with reference to the appended drawings, of which.

DETAILED DESCRIPTION

Figure 1:
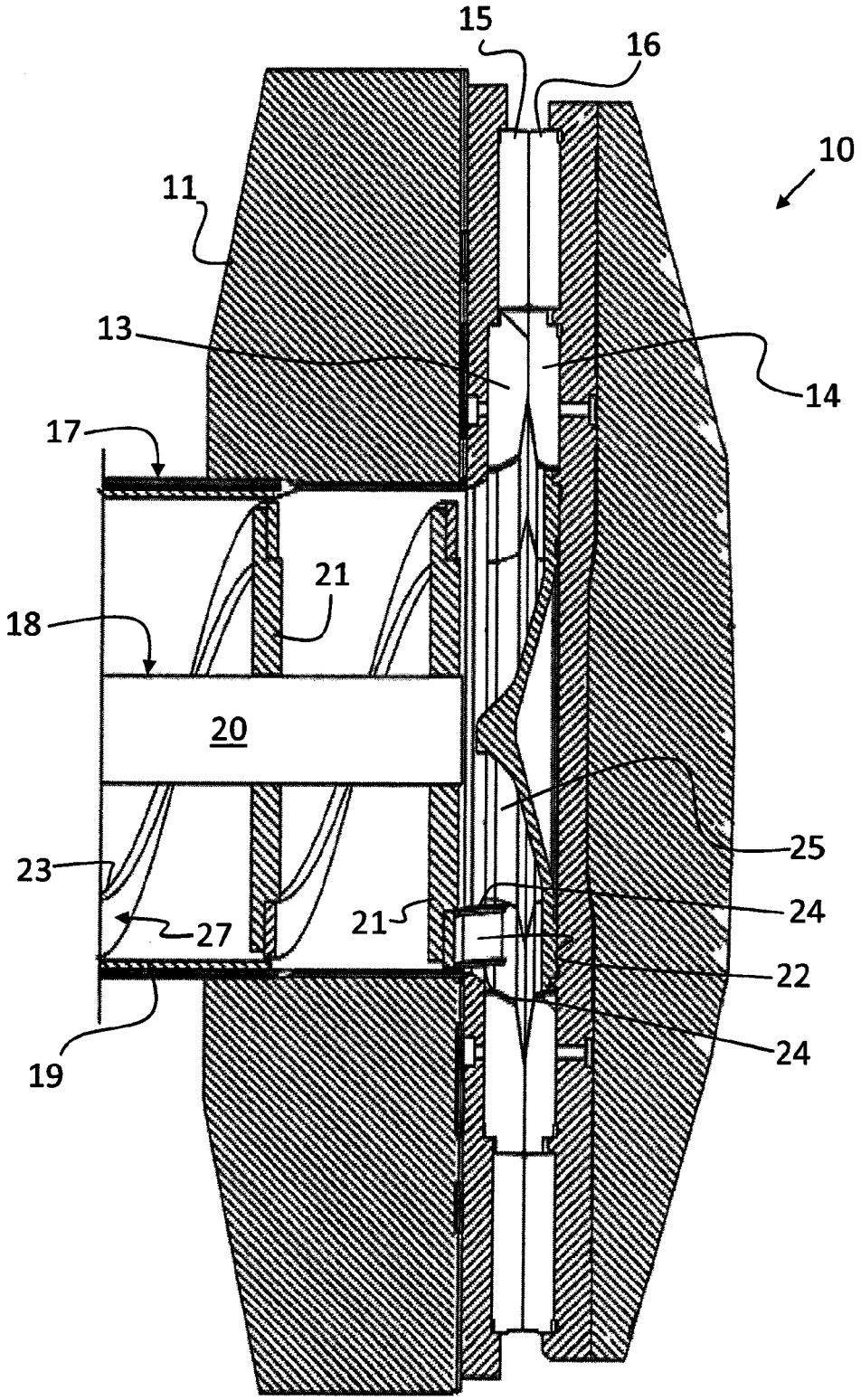
FIG. 1 is a side, elevational, sectional view of a feeding zone of a grinder with a feed screw arrangement according to one embodiment of the present invention.

The arrangement shown in FIG. 1 includes a grinder 10 with a stator disc 11 and an opposed rotor disc 12. The stator disc 11 and the rotor disc 12 define a peripheral grinding zone between them. The peripheral grinding zone includes a pre-grinding zone and a main grinding zone. The pre-grinding zone is formed between two inner opposed grinding segments 13 and 14 of the stator 11 and rotor 12, respectively. Outside this pre-grinding area, in the radial direction, the main grinding zone is formed between two outer opposed grinding segments 15 and 16 of the stator 11 and rotor 12, respectively.

Chips or any other lignocellulose material such as pulp, fibers, straws are arranged to be conveyed in a feeding direction to the peripheral grinding zone by means of a feed screw arrangement 17 comprising a feed screw 18 that is axially arranged inside a cylindrical pipe 19 and rotates around an axial shaft 20. In this description the term chips is used to denote all possible lignocellulose materials that may be fed by the feed screw. The present invention is, however, not limited to the feeding of a specific material.

In the shown embodiments the feed screw 18 comprises a peripheral thread 23 or a spiral (helix) with a hollow inner section. The peripheral thread 23 is connected to the axial shaft 20 by means of connectors 21, which in the shown embodiment is constituted of spoke-like arms. Another possible design of the connectors is to use plates that may be arranged alongside the shaft. The arrangement with a partly hollow interior between the axial shaft 20 and the peripheral thread 23 allows fluid, such as gas or steam, to pass opposite the feeding direction in which the lignocellulose material is conveyed.

The feed screw 18 is arranged to rotate at about 300-2000 rotations per minute. This relatively high rotational speed contributes to the formation of centrifugal forces that assures that the chips will be kept close to the inside wall of the cylindrical pipe 19, such they will not end up inside of the width of the peripheral thread 23. Hence, the chips will be conveyed into the grinding zone by the feed screw 18 in close contact with both the peripheral thread 23 and the inside of the cylindrical pipe 19.

The peripheral thread 23 of the feed screw 18 may have the same pitch or pitch angle throughout the whole extension of the cylindrical pipe 19. The pitch angle is in this application defined as the angle of peripheral thread 23 with respect to the normal plane of the axial shaft 20. Hence, the pitch angle may theoretically be between 0° and 90°, where a pitch angle of 0° results in no axial feeding at all, and where the feeding velocity will increase with an increasing pitch angle.

The optimal pitch angle is, however, dependent of the rotational speed of the feed screw 18. Further, it is dependent from the diameter of the feed screw 18 and the cylindrical pipe 19. The higher the pitch angle of the peripheral thread 23, the higher the feeding velocity of the chips. The chips are pushed in the axial direction by the action of the peripheral thread 23. The rotation of the peripheral thread 23 also gives the chips a push in the angular direction, due to the friction between the peripheral thread 23 and the chips. Further, as indicated above, due to the relatively high rotating speed of the peripheral thread 23 the chips will be exposed to centrifugal forces that will keep them in close contact with the inside of the cylindrical pipe 19.

In accordance with the present invention, the feed screw 18 includes an angled end part 22 for releasing the chips in the radial direction towards the peripheral grinding zone. The angled end part 22 is angled so as to redirect the chips, which are conveyed in a mainly axial direction inside the cylindrical pipe 19, to a partly radial direction towards the grinding zone as they exit the cylindrical pipe. This is achieved in that the angled end part 22 is arranged at an angle with respect to the peripheral thread 23.

The re-directing of the chips is not such that the chips will be re-directed so as to be conveyed in the radial direction only. Namely, the chips have an inherent kinetic energy in both the axial and the angular direction as they reach the angled end part 22 and this kinetic energy will not be totally lost. Part of the axial/angular kinetic energy will, however, be transferred into kinetic energy in the radial direction. The actual re-direction of the chips, or their kinetic energy, is dependent on the shape and parameters of the actual feed screw arrangement 17. The aim of the re-direction of the chips is to give them enough kinetic energy in the radial direction so as to direct them towards the gap between the discs 11 and 12.

Further, the angled end part 22 may be arranged so as to re-direct the chips radially inwards, such that the chips will be directed towards the gap between the discs 11 and 12 at the radial opposite side, or radially outwards, such that the chips will be directed towards the same gap at the same radial side from which they are released. The chips will, however, also be conveyed in a direction that has both an angular and an axial component.

The angle of the angled end part 22 should, however, be such that the chips will receive a push in the radial direction. This may be achieved in many different manners, whereof the shown embodiments represent two examples. Generally, the angled part 22 contributes to giving the peripheral thread 23 a momentary increased pitch angle, such that the chips will be redirected from the feeding direction they have inside the cylindrical pipe 19.

Figure 2:
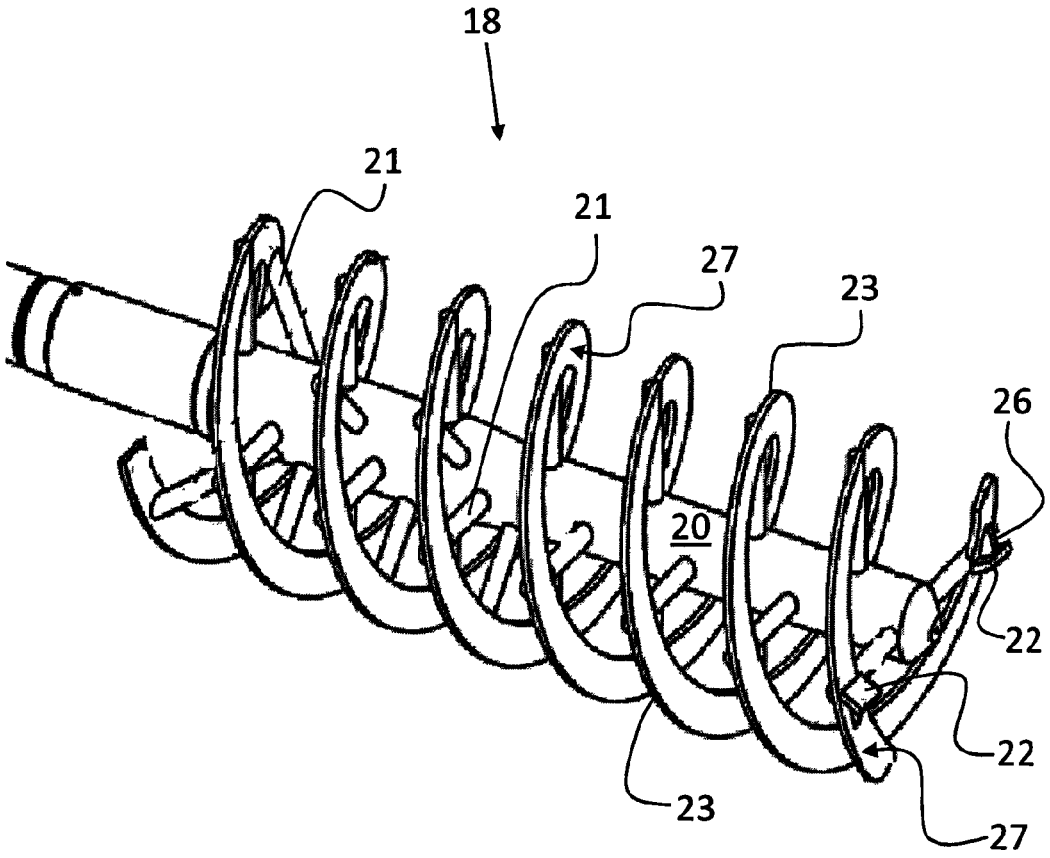
FIG. 2 is a side, perspective view of the feed screw shown in FIG. 1.

In the first embodiment shown in FIGS. 1 and 2 the angled end part 22 consists of a straight plate that is fixed to the peripheral thread 23 at an abrupt angle with respect to the feed screw. In this context an abrupt angle indicates that the angle of the end part 22 with respect to the peripheral thread 23 is achieved in one single point, such that pitch angle of the peripheral thread 23 gets a sudden increase by means of the angled end part 22. The pitch angle thus has one value upstream of the point of the abrupt angle and another, higher value, downstream of the same point. Due to the abrupt angle the chips will bounce on the angled end part 22 towards the peripheral grinding zone.

Figure 3:
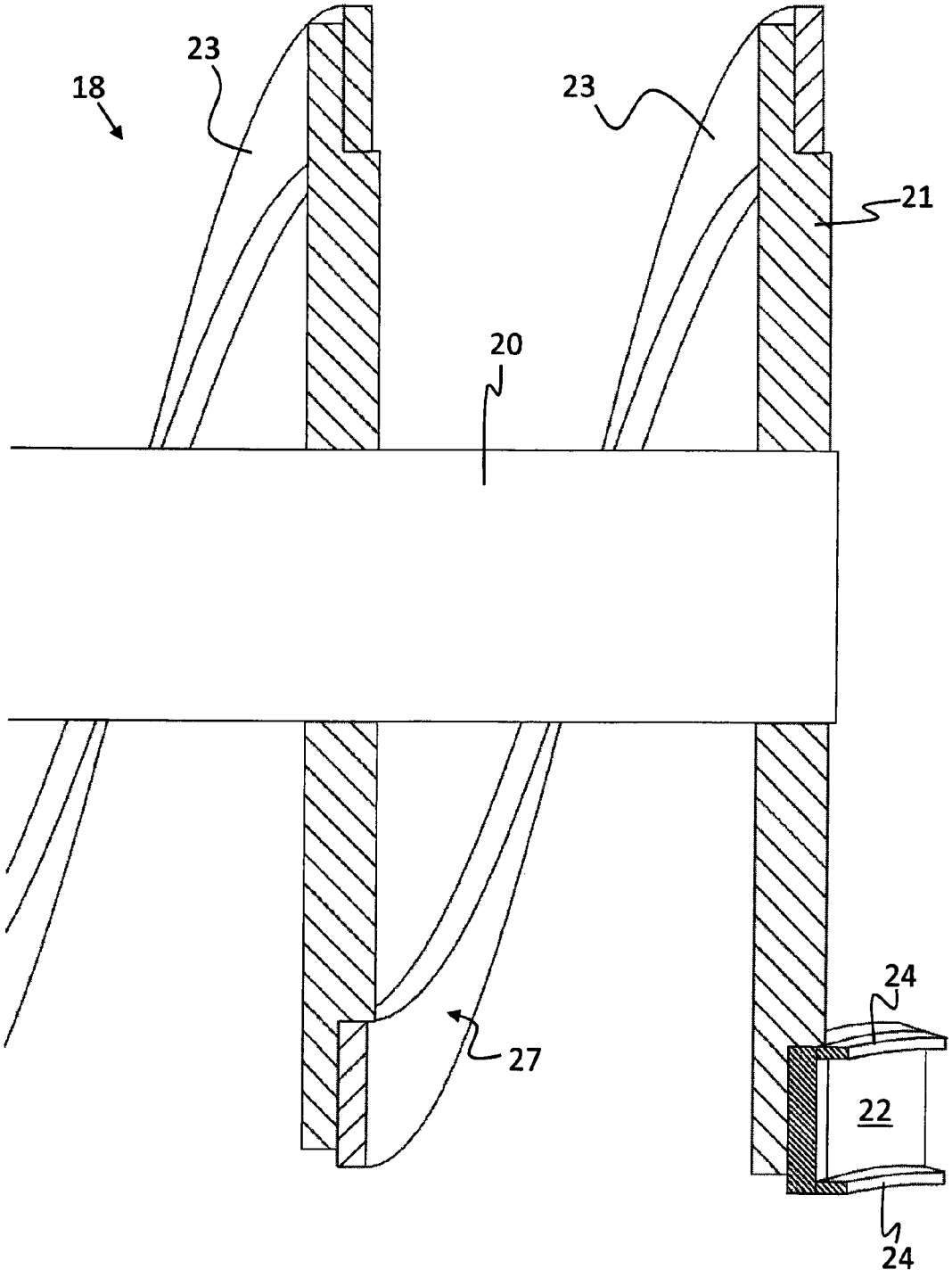
FIG. 3 is a side, evelational, parital sectional view of a feed screw according to another embodiment of the present invention.

A second embodiment of the angled end part 22 is shown in FIG. 3. In this embodiment the end part 22 has a smoothly curved surface arranged to provide a smooth transition for the chips, such that the chips will be swung towards the grinding zone. In this embodiment the increase of the pitch angle with respect to the peripheral thread 23 is smoothly increasing, instead of having an abrupt angle. An advantage of this embodiment is that the release angle of the chips will be easier to control, due to the fact that a more predictable trajectory of the chips may be achieved.

Both embodiments of the inventive angled end part may be easily implemented in an existing feeding arrangement, e.g., by welding a plate to the peripheral thread or by attaching it by means of an angle bar 26 on the peripheral thread 23. The peripheral thread 23 has a feeding side 27 which is in contact with the chips as they are fed through the cylindrical pipe 19. Naturally, the angled end part 22 is attached to this feeding side 27 of the peripheral thread 23.

Another possible way of implementing the angled end part 22, regardless of the embodiment, is to attach it as a continuation of the end of the peripheral thread 23, e.g., downstream with respect to the peripheral thread 23.

Regardless of which type of angled end part 22 is used, the end part 22 may be furnished with lateral rims 24 or edges in order to direct the chips in a more predictable way and to prevent the chips from sliding laterally on the end part 22 such that some part of the effect provided by it may be lost. The edges may be either rounded or straight. The lateral rims 24 may be arranged at both lateral sides of the angled end part 22 or at just one lateral side of it, depending on the forces acting in the specific embodiment. In the embodiments shown in FIGS. 1 and 3 the lateral rims 24 are arranged at a straight angle of about 90° with respect to the main part of the angled end part 22. Other angles are however possible.

Above, specific embodiments of the invention have been described with reference to the schematic drawings. The invention is however not limited to either of these. Instead, the invention is only limited by the scope of the following claims.

The invention claimed is:

1. A feed screw for feeding lignocellulosic material to a rotary disc refiner comprising a pair of opposed grinding surfaces, said feed screw comprising at least one peripheral thread for feeding said lignocellulosic material axially along said feed screw towards said rotary disc refiner, said at least one peripheral thread including an upstream end and a downstream end corresponding to the pair of opposed grinding surfaces whereby said feed screw feeds said lignocellulosic material from said upstream end toward said downstream end through the center of one of said pair of opposed grinding surfaces, said downstream end of said at least one peripheral thread including an angled end member directly affixed to and disposed at an angle with respect to said at least one peripheral thread whereby said lignocellulosic material is re-directed in a radial direction as it leaves said at least one peripheral thread.

2. The feed screw according to claim 1, wherein said at least one peripheral thread has a predetermined pitch angle upstream of said angled end member, and wherein said angled end member includes an increased pitch angle compared to said predetermined pitch angle.

3. The feed screw according to claim 1, wherein said angled end member comprises a straight plate fixed to said at least one peripheral thread at an abrupt angle with respect thereto.

4. The feed screw according to claim 1, wherein said at least one peripheral thread includes a predetermined pitch angle upstream of said angled end member, and wherein said angled end member includes a smoothly curved surface providing a smoothly increased pitch angle compared to said predetermined pitch angle.

5. The feed screw according to claim 1, wherein said angled end member comprises a continuation of said at least one peripheral thread.

6. The feed screw according to claim 1, wherein said angled end member is disposed on a feeding side of said at least one peripheral thread.

7. A grinder comprising a pair of opposed grinding surfaces and including a feed screw for feeding lignocellulosic material to said grinder, said feed screw including an outer cylindrical pipe whereby said feed screw is disposed within said outer cylindrical pipe, said feed screw including said outer cylindrical pipe disposed extending through the center of one of said pair of opposed grinding surfaces and into a feed zone between said pair of opposed grinding surfaces, said feed screw including at least one peripheral thread for feeding said lignocellulosic material axially along said feed screw toward said feeding zone between said pair of opposed grinding surfaces, said at least one peripheral thread including an upstream end and a downstream end corresponding to the feeding zone between said pair of opposed grinding surfaces, said downstream end of said at least one peripheral thread including an angled end member disposed at an angle with respect to said at least one peripheral thread whereby said lignocellulosic material is redirected in a radially direction into said feeding zone.

8. A grinder according to claim 7, wherein one of said pair of opposed grinding surfaces comprises a stator disc and the other of said pair of opposed grinding surfaces comprises a rotor disc, said feed screw and said cylindrical pipe being disposed through the center of said stator disc.

9. A feed screw for feeding lignocellulosic material to a rotary disc refiner comprising a pair of opposed grinding surfaces, said feed screw comprising at least one peripheral thread for feeding said lignocellulosic material axially along said feed screw towards said rotary disc refiner, said at least one peripheral thread including an upstream end and a downstream end corresponding to the pair of opposed grinding surfaces whereby said feed screw feeds said lignocellulosic material from said upstream end toward said downstream end through the center of one of said pair of opposed grinding surfaces, said downstream end of said at least one peripheral thread including an angled end member disposed at an angle with respect to said at least one peripheral thread whereby said lignocellulosic material is re-directed in a radial direction as it leaves said at least one peripheral thread, and wherein said angled end member includes at least one lateral rim preventing said lignocellulosic material from slipping sideways with respect to said angled end member.

10. A feed screw for feeding lignocellulosic material to a rotary disc refiner comprising a pair of opposed grinding surfaces, said feed screw comprising a pair of peripheral threads for feeding said lignocellulosic material axially along said feed screw towards said rotary disc refiner, each of said pair of peripheral threads including an upstream end and a downstream end corresponding to the pair of opposed grinding surfaces whereby said feed screw feeds said lignocellulosic material from said upstream end toward said downstream end through the center of one of said pair of opposed grinding surfaces, said downstream end of each of said pair of peripheral threads including an angled end member disposed at an angle with respect to each of said pair of peripheral threads whereby said lignocellulosic material is re-directed in a radial direction as it leaves each of said pair of peripheral threads.

11. A feed screw for feeding lignocellulosic material to a rotary disc refiner comprising an outer cylindrical pipe, said feed screw being disposed within said outer cylindrical pipe, said rotary disc refiner comprising a pair of opposed grinding surfaces, said feed screw comprising at least one peripheral thread for feeding said lignocellulosic material axially along said feed screw towards said rotary disc refiner, said at least one peripheral thread including an upstream end and a downstream end corresponding to the pair of opposed grinding surfaces whereby said feed screw feeds said lignocellulosic material from said upstream end toward said downstream end through the center of one of said pair of opposed grinding surfaces, said downstream end of said at least one peripheral thread including an angled end member disposed at an angle with respect to said at least one peripheral thread whereby said lignocellulosic material is re-directed in a radial direction as it leaves said at least one peripheral thread.

* * * * *